United States Patent [19]

Fields et al.

[11] Patent Number: 4,553,066

[45] Date of Patent: Nov. 12, 1985

[54] MULTIPLE FILAMENT LAMP HAVING WIRE GRID TO PROVIDE FILAMENT REDUNDANCY

[75] Inventors: Larry R. Fields, Winchester; George B. Kendrick, Lexington, both of Ky.

[73] Assignee: GTE Products Corporation, Stamford, Conn.

[21] Appl. No.: 521,499

[22] Filed: Aug. 8, 1983

[51] Int. Cl.[4] ..... H01K 1/26; H01K 9/00

[52] U.S. Cl. ..... 313/580; 313/579; 313/272

[58] Field of Search ..... 313/579, 272, 273, 279, 313/580, 236, 578

[56] References Cited

U.S. PATENT DOCUMENTS

| | | | |
|---|---|---|---|
| 2,005,194 | 6/1935 | Mayo | 176/26 |
| 2,326,419 | 8/1943 | Van Horn | 313/272 X |
| 3,493,806 | 2/1970 | Jacobs | 313/113 |
| 3,777,207 | 12/1973 | Notelteirs et al. | 313/273 X |
| 3,784,861 | 1/1974 | Notelteirs et al. | 313/117 |
| 4,074,167 | 2/1978 | van den Broek et al. | 313/331 X |
| 4,145,630 | 3/1979 | De Caro et al. | 313/579 X |
| 4,288,844 | 9/1981 | Fisher et al. | 362/33 |
| 4,361,779 | 11/1982 | van der Steen et al. | 501/54 X |
| 4,361,780 | 11/1982 | Brons | 313/178 X |

*Primary Examiner*—David K. Moore
*Assistant Examiner*—K. Wieder
*Attorney, Agent, or Firm*—Lawrence R. Fraley

[57] ABSTRACT

A multi-filament lamp that includes a tubular envelope having a pinch seal at one end thereof and containing therein a halogen atmosphere. At least two coiled tungsten filaments are disposed in the tubular envelope and are supported so as to be oriented parallel to each other in the longitudinal direction of the envelope. Lead-in wires are provided within the envelope and are hermetically sealed using metal foil strips, these being hermetically sealed within the pinch seal. Outer lead-in wires extend from the pinch seal and are each connected to a respective contact pin. A lead-in wire is associated with each filament and a common lead-in wire is also provided. A wire grid extends longitudinally within the envelope substantially in parallel to the filaments and is disposed therebetween so as to isolate one filament from the other and thereby provide filament redundancy.

14 Claims, 5 Drawing Figures

MULTIPLE FILAMENT LAMP HAVING WIRE GRID TO PROVIDE FILAMENT REDUNDANCY

TECHNICAL FIELD

The present invention relates in general to an improved multi-filament lamp, and in particular to an improved lamp of the tungsten-halogen type. Even more particularly, the invention is concerned with an improved lamp construction that provides a redundant (in that one filament cannot interfere with another at filament failure) multi-filament lamp.

BACKGROUND

Double filament lamps are shown, by way of example, in U.S. Pat. Nos. 2,005,194, 3,493,806, 3,777,207, 3,784,861, 4,074,167, 4,361,779 and 4,361,780. A multi-filament lamp is described in U.S. Pat. No. 4,288,844 which, in some embodiments described therein, includes more than two filaments. In particular, this patent illustrates a lamp wherein two or more filaments are arranged perpendicular to the optical axis to the light. With such an arrangement, redundancy is not provided because one filament is free to fall directly onto the other upon failure thereof. Similarly, in the other patents referred to herein, redundancy (isolation from filament-to-filament) is not provided and thus at failure of any one filament, there tends to be interference with the non-failed filament.

In the past, separate lamp envelopes have been used in an effort to provide desired redundancy or isolation. However, this has typically resulted in a more complex and thus more costly overall lamp construction.

DISCLOSURE OF THE INVENTION

It is an object of the present invention to provide an improved multi-filament lamp that is particularly adapted for providing redundant multi-filament operation.

Another object of the present invention is to provide a multi-filament lamp, such as a tungsten-halogen lamp having a tubular envelope with a press-seal at one or both ends and from which lead wires extend to allow one or more of the enclosed filaments to be separately and selectively energized.

A further object of the present invention is to provide a redundant multi-filament lamp that is economical to construct and is of relatively simple construction.

Still another object of the present invention is to provide an improved multi-filament lamp in which positioning of the filament coils can be closely controlled during manufacture, especially during the press-seal operation.

In accordance with the present invention, there is provided an improved multi-filament lamp which insures lamp redundancy and which has filament positions strictly controlled. The lamp has a sealed tubular envelope constructed of vitreous material having a press-seal at one or both ends thereof. The tubular envelope may be comprised of quartz or high silica glass. A halogen-containing atmosphere is enclosed within the envelope as are two or more coiled tungsten filaments. Means are provided for supporting the filaments in parallel to each other in the longitudinal direction within the envelope (parallel to the envelope's axis). Lead-in wires extend through the press-seal and include at least one lead-in wire associated with each filament, as well as a common lead-in wire. Means are provided, such as foil strips, for connecting the lead-in wires to the filament supporting means. A wire grid extends longitudinally within the envelope substantially parallel to the filaments and is disposed therebetween so as to isolate one filament from the other and thus provide filament redundancy. In this context, filament redundancy refers to the condition wherein one filament does not interfere (physically) with another upon failure of one of said filaments. The wire grid may be of a single or multiple wire construction.

BEST MODE FOR CARRYING OUT THE INVENTION

For a better understanding of the present invention together with other and further objects, advantages and capabilities thereof, reference is made to the following disclosure and appended claims in connection with the above-described drawings.

Figure 1:
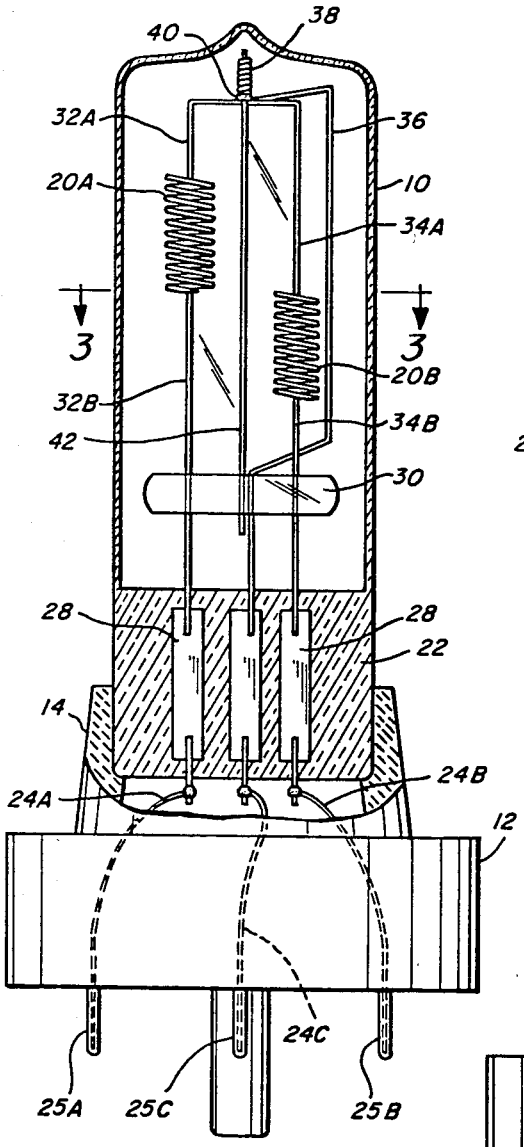
FIG. 1 is the cross-sectional view of a double-filament lamp constructed in accordance with the principles of the present invention.

With regard to the drawings, and in particular FIG. 1, there is shown a multiple filament lamp which is constructed to provide filament redundancy so that one filament will not interfere (physically) with another upon failure of one of the filaments. In accordance with the construction of this invention, the positions of the filaments relative to each other are precisely established, with the filaments also being oriented so as to be energized either separately or together.

With reference to FIG. 1, there is shown a double-filament lamp including a tubular lamp envelope 10, a base shell 12, a ceramic insulator 14, and coiled tungsten filaments 20A and 20B. The lamp described in FIG. 1 may be a tungsten-halogen lamp and the tubular envelope may be constructed of quartz or high silica glass. Although the press (or pinch) seal may be provided at both ends, in the embodiment of FIG. 1 there is shown a press-seal 22 at only one end of the envelope 10. The atmosphere within the envelope contains a halogen, such as bromine. The lamp operates on a regenerative cycle initiated when a tungsten halide is produced and chemically combines with particles evaporated from the energized filament to thus prevent evaporated tungsten particles from depositing on the other filaments or on the envelope wall.

The filaments are energized by way of lead-in wires. One lead-in wire is provided per filament in addition to one common wire per lamp. FIG. 1 shows filament lead-in wires 24A and 24B, and the common lead-in wire 24C. These lead-in wires are shown as being electrically coupled to contact pins 25A, 25B, and 25C, respectively. The contact pins may be supported from the metallic base shell 12 in a conventional manner. Each lead-in wire extends through the base shell and ceramic insulator 14 to a respective, electrically conductive foil strip 28. Each foil strip 28 is preferably of thin molybdenum material, with each being disposed in the press-seal 22. One molybdenum foil is used per filament, and one common foil is employed for the common lead-in wire 24C. Lead-in wires 24A, 24B and 24C are depicted in FIG. 1 as each comprising two leads, one (a linear section) being secured to a bottom portion of the foil and a second (external) lead welded thereto for attachment to the respective contact pin. In each of these leads, there may also be provided a fuse (not shown).

Figure 2:
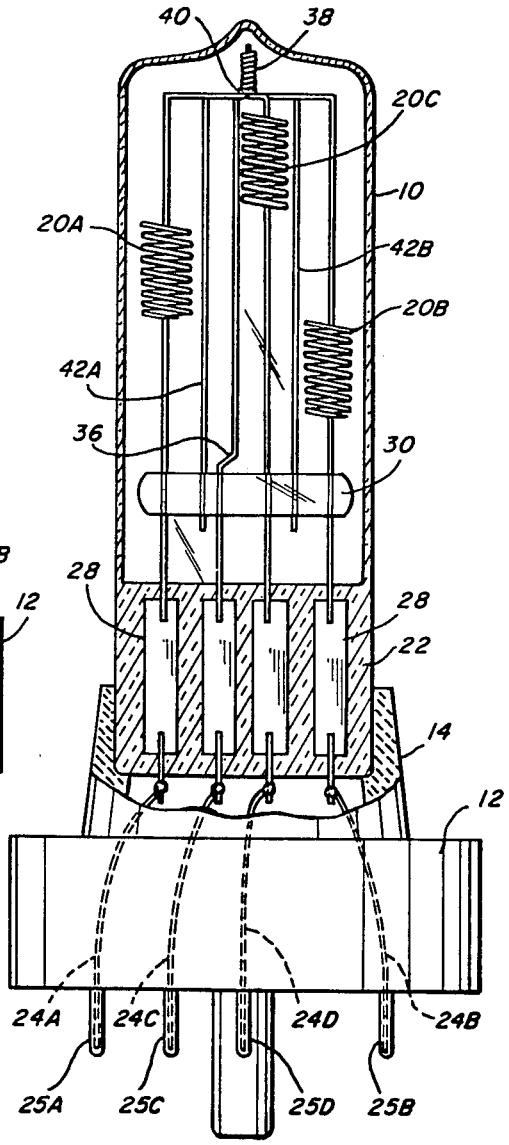
FIG. 2 is a cross-sectional view similar to the view of FIG. 1 but showing a lamp containing three filaments therein.

As depicted in FIGS. 1 and 2, filaments 20A and 20B are disposed in the invention in parallel to the longitudinal axis of the lamp's tubular-shaped envelope 10. This parallel arrangement is made possible by, and the filament spacing is maintained by, sealing the filament ends and support wire ends in a bridge 30 formed from a rod of quartz material. In FIG. 1, filaments 20A and 20B are supported by hooked-type inserts, which in turn reduce the effect of arcing which might separate the entire filament body from its support. Accordingly, associated with filament 20A is an upper insert 32A and a lower insert 32B. Similarly, associated with filament 20B is an upper insert 34A and a lower insert 34B. As indicated previously, all of these inserts are of the hooked-type. That is, each insert, being a wire, is hooked (or looped) at the end thereof and the corresponding end of the filament hooked thereover. There is also provided a lead wire 36 which is common (electrically) to all filaments. It is noted that lead wire 36 is bent away from the filament axis and extends for the majority of its length close to the wall of the envelope 10. It is also noted that this common lead wire, as well as inserts 32A and 34A, are physically joined by placing a small minor coil 38 over all of the leads and welding at a common location 40.

The lower inserts 32B and 34B, in addition to the common lead 36, are supported by the quartz bridge 30. It is noted that these leads extend through the bridge and are each attached to the top portion of the respective thin strips 28 of molybdenum foil. The inserts 32B, 34B and the common lead 36 are of course electrically insulated from each other within the quartz bridge 30.

In accordance with the teachings of the instant invention, a screen is located between the filaments 20A and 20B to provide the aforementioned desired redundancy, said screen comprising a wire grid 42. Wire grid 42 may be comprised of one or more wires (as discussed hereinafter in connection with FIGS. 3A, 3B and 3C). It may also be supported from the upper common point 40 and is implanted within bridge 30 to assure positive support therefor. In the embodiment of FIG. 1, grid 42 is shown conductively secured at its lower end to the common lead 36, with the common lead 36 in turn coupled to the centrally-disposed foil strip 28.

With the placement of wire grid 42 between the lamp's filaments, there is provided the aforementioned redundancy. Thus, if during or immediately after failure of one of the filaments, said filament tends to move toward the other filament (as occasionally occurs), the interposed wire grid which is hot causes the failed filament to arc out and quickly cool. This in turn uniquely prevents the other, non-failed filament from burning out. Redundancy is thus assured.

In FIG. 2 there is shown a multi-filament lamp which comprises three filaments. The principles of construction are substantially the same as described previously in connection with the lamp in FIG. 1. Thus, in FIG. 2, like reference characters are used to identify like parts of the lamp of FIG. 1. In FIG. 2, the multi-filament lamp includes a tubular envelope 10 which has supported therein three filaments 20A, 20B and 20C. Again, the tubular envelope may be constructed of quartz or high silica glass. Enclosed within the envelope is a halogen-containing atmosphere. In view of the utilization of three filaments, there are thus three filament lead-in wires 24A, 24B and 24D, as well as a common lead-in wire 24C. These lead-in wires are associated with (connected to) the contact pins 24A, 24B, 24C and 24D, respectively. The lamp in FIG. 2 also includes a quartz bridge 30 which supports the lower legs (or inserts) associated with each of the three filaments. Quartz bridge 30 also serves to support the common lead 36. As with the embodiment of FIG. 1, the upper leads or legs associated with each of the filaments are in turn joined with the common lead 36 at a common weld point 40 at which is also supported a minor coil 38. As also with the embodiment of FIG. 1, the lamp has a base member of insulating material, such as ceramic. At least one slot (not shown) is provided in the base to accommodate the press seal 22. The base member as indicated previously, also contains one pin contact for each lamp filament, in addition to one for the common lead. There is also shown a base metallic shell 12 which functions to cover the insulative base member 14.

In FIG. 1 there was described a single grid 42 disposed between the two filaments 20A and 20B. In the embodiment of FIG. 2, because there are three filaments employed, two grids 42A and 42B are utilized. Grid 42A is disposed between filament 20A and the filament 20C, while grid 42B is disposed between the filament 20B and the filament 20C. Each of these grids may be supported from the top support leads of the filaments (as shown) and is embedded in the quartz bridge 30.

Unlike the embodiment of FIG. 1, in FIG. 2 it is noted that the bottom of the grids 42A and 42B are supported in the bridge 30 in an electrically insulated manner (the grid in FIG. 1 being coupled to the common wire 36). In this invention, the preferred embodiment for connection of the various wire grids is that depicted in FIG. 1.

Figure 3A:
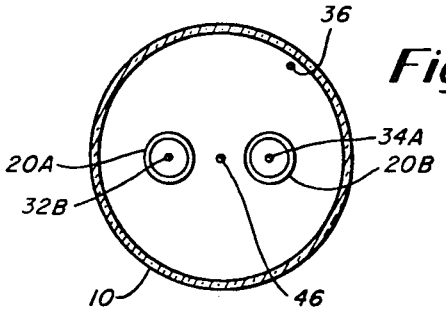
FIGS. 3A, 3B, and 3C show cross-sectional views taken along line 3—3 of FIG. 1 for three different embodiments of the wire grid of the invention, including a single-wire, triple-wire and four-wire construction, respectively.
Figure 3B:
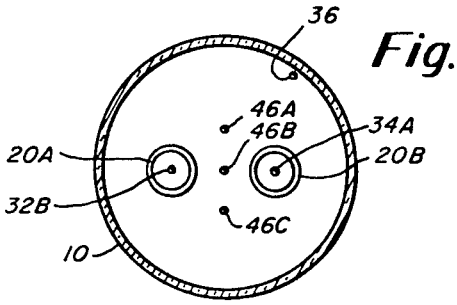
Figure 3C:
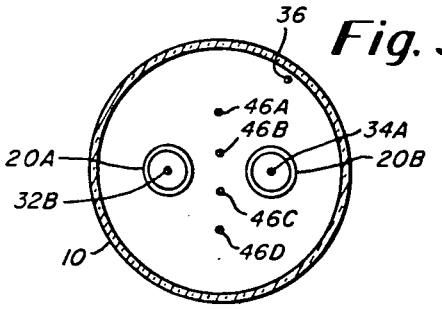

FIGS. 3A, 3B and 3C show cross-sectional views, such as taken along line 3—3 of FIG. 1, showing three different embodiments for the wire grid of the invention. In FIG. 3A, there is shown a single wire grid 46 disposed between the filaments 20A and 20B. In FIG. 3B there are shown three wires 46A, 46B, and 46C separating filaments 20A and 20B. Finally, in FIG. 3C there is shown an arrangement in which there are provided four individual grid wires 46A, 46B, 46C and 46D. In the embodiments of FIGS. 3B and 3C, the grid wires are oriented in parallel and extend along a line that is substantially perpendicular to the line connecting the two filament centers (left to right in FIGS. 3A–3C). As indicated previously, the wire grid is used to provide redundancy so that any one filament does not interfere with another upon a filament failure. Filament redundancy is also assisted by the use of the preferred hook-type inserts which reduce the effect of arcing which in turn might result in the filament body separating from its supports.

While there have been shown and described what are at present considered the preferred embodiments of the invention, it will be obvious to those skilled in the art that various changes and modifications may be made therein without departing from the scope of the invention as defined by the appended claims.

What is claimed is:

1. A multi-filament lamp comprising:

a tubular envelope having at least one pinch seal at an end thereof;

a halogen atmosphere within said tubular envelope;

at least two spaced apart, coiled filaments disposed in said tubular envelope;

means for supporting said coiled filaments in parallel to each other in the longitudinal direction within said tubular envelope;

lead-in wire means extending through the pinch seal and including a lead-in wire associated with each filament and a common lead-in wire;

means connecting said lead-in wire means to said means supporting said coiled filaments; and a wire grid in the form of a single, electrically conductive wire extending longitudinally within said tubular envelope substantially in parallel to said coiled filaments and disposed therebetween so as to isolate one filament from the other, thereby providing filament redundancy in the event of failure of one of said coiled filaments during lamp operation, an arc being formed between said failed filament and said wire grid as said filament approaches said wire grid, said wire grid being electrically coupled to said common lead-in wire.

2. A multi-filament lamp according to claim 1 further including an electrically insulating bridge located within said envelope for providing support for said coiled filaments.

3. A multi-filament lamp according to claim 2 wherein said means for supporting said coiled filaments includes insert means secured at each end of each of said coiled filaments, each of said insert means being supported at one end thereof within said bridge.

4. A multi-filament lamp according to claim 3 further including a common support wire located within said tubular envelope and extending from said bridge, said insert means being electrically connected to said common support wire at one end thereof.

5. A multi-filament lamp according to claim 4 further including a minor coil located within said envelope and electrically connected to each of said coiled filaments at said end of said common support wire electrically connected to said insert means.

6. A multi-filament lamp according to claim 1 wherein the number of said coiled filaments is three.

7. A multi-filament lamp according to claim 1 wherein each of said means connecting said lead-in wire means to said means supporting said coiled filaments includes a foil strip located within said pinch seal.

8. A multi-filament lamp according to claim 1 further including an electrically insulating base member for accommodating said pinch seal end of said envelope and for receiving said lead-in wire means.

9. A multi-filament lamp according to claim 8 further including a plurality of contact pins, each of said pins attached to said lead-in wire means and supported within said base member.

10. A multi-filament lamp according to claim 9 wherein each of said contact pins is electrically joined to a respective one of said coiled filaments, said lamp further including at least one common contact pin electrically connected to said common lead-in wire.

11. A multi-filament lamp according to claim 1 wherein said wire grid further includes at least one additional electrically conductive wire extending longitudinally within said tubular envelope adjacent and parallel to said single, electrically conductive wire.

12. A multi-filament lamp according to claim 11 wherein the number of said additional electrically conductive wires is within the range of from one to three.

13. A multi-filament lamp according to claim 12 wherein said grid wires extend along a plane substantially perpendicular to a center line connecting centers of said two coiled filaments.

14. A multi-filament lamp according to claim 1 including an electrically insulating bridge located within said envelope for providing support for said coiled filaments, said wire grid also being supported by said bridge.

* * * * *